United States Patent [19]

Matsuhashi et al.

[11] Patent Number: 4,845,473

[45] Date of Patent: Jul. 4, 1989

[54] METHOD OF DRIVING A LIQUID CRYSTAL MATRIX DISPLAY PANEL

[75] Inventors: Nobuaki Matsuhashi; Makoto Takeda, both of Tenri; Kunihiko Yamamoto, Nara; Hiroshi Take, Ikoma, all of Japan

[73] Assignee: Sharp Kabushiki Kaisha, Osaka, Japan

[21] Appl. No.: 161,431

[22] Filed: Apr. 24, 1988

Related U.S. Application Data

[63] Continuation of Ser. No. 739,851, May 31, 1985, abandoned.

[30] Foreign Application Priority Data

Jun. 1, 1984 [JP] Japan ..... 59-113743

[51] Int. Cl.[4] ..... G09G 3/36

[52] U.S. Cl. ..... 340/784; 340/765; 340/805

[58] Field of Search ..... 340/784, 765, 718, 719, 340/805; 350/332, 333; 358/230, 236, 241

[56] References Cited

U.S. PATENT DOCUMENTS 3,787,834 1/1974 Elliott ..... 340/784
4,275,421 6/1981 Louie et al. ..... 340/784
4,317,115 2/1982 Kawakami et al. ..... 340/784
4,481,511 11/1984 Hanmura et al. ..... 340/784
4,525,710 6/1985 Hoshi et al. ..... 340/784
4,536,060 8/1985 Takamatsu et al. ..... 350/343

FOREIGN PATENT DOCUMENTS 2139795 11/1984 United Kingdom ..... 350/333

*Primary Examiner*—Donald J. Yusko
*Assistant Examiner*—Jeffery A. Brier
*Attorney, Agent, or Firm*—Birch, Stewart, Kolasch & Birch

[57] ABSTRACT

A method of driving a matrix-type liquid crystal display panel comprising the step of dividing each scan pulse delivered to a plurality of row electrodes connected to the liquid crystal panel into plural scan periods; supplying video signal data via real-time operation during the initial divided period during alernate scan periods; generating new and proper signal source during the rest of the scan periods; and supplying data from the new signal source so that data can be written into liquid crystal layers. When dividing the width of the scan pulse into n pulses, the frame frequency can be raised n-times, thus making it possible to achieve a satisfactory liquid crystal picture display without the slightest flicker.

10 Claims, 3 Drawing Sheets

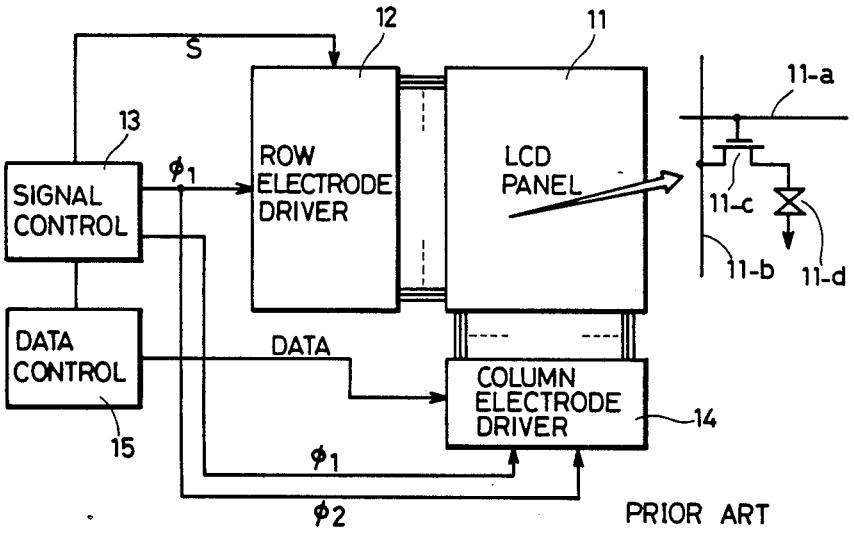
FIG. 1 (A)
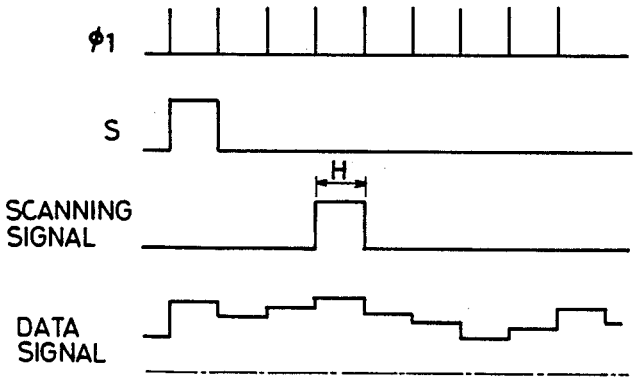
FIG. 1 (B) PRIOR ART

METHOD OF DRIVING A LIQUID CRYSTAL MATRIX DISPLAY PANEL

This application is a continuation of application Ser. No. 739,851 file on May 31, 1985, now abandoned.

BACKGROUND OF THE INVENTION

1. Field of the Invention

The present invention relates to a matrix-type liquid crystal display panel and, more particularly, to the method of driving such a liquid crystal display panel provided with a plurality of switching transistors connected to respective picture elements available for matrix display patterns.

2. Description of Prior Art

Conventionally, it is well known that, by providing a number of switching transistors in a matrix formation inside a liquid crystal display panel of a matrix-type liquid crystal display unit, a sharp-contrast display substantially equivalent to any static driver system can be realized, even when executing multi-line multiplex driving using a low duty ratio. Normally, such a matrix-type liquid crystal display panel has the circuit configuration shown in FIG. 1 (A) with signal waveforms as in FIG. 1 (B). In FIG. 1, reference number 11 indicates the liquid crystal display panel, in which switching transistor 11-*c* is connected to the crossing point of the row electrode 11-*a* and the column electrode 11-*b*. Reference number 11-*d* indicates a capacitor substantially made of liquid crystal layers. Reference number 12 indicates the row electrode driver comprised of shift-registers where the clock pulse $\phi$1 sequentially shifts the scan pulse S before the phase-shifted scan pulse S is eventually delivered to respective row electrodes. If the total scan time is designated as T and the number of scan lines as N, then the width H of the scan pulse can be denoted by $H=T/N$. A pulse voltage of width H is sequentially delivered to each row electrode so that a number of thin-film transistors in each row is activated from row to row. Reference number 14 indicates the column electrode driver comprised of shift-registers and sample-hold circuits, which samples the data signal transmitted in series from the data controller synchronous with clock pulse $\phi$2, at the timing dealing with each column, and then outputs the sampled value to respective electrodes after holding it for the 1−H scan period. To drive liquid cyrstals using AC current, a data signal waveform is supplied while inverting its polarity in each scan line. When driving is performed using the method described above, the total scan period T is computed by the formula $T$=(width H of the scan pulse) X (number $N$ of scan lines), but, since it is necessary to invert the polarity of the data signal waveform in every scan line to drive liquid crystals using AC current, the frame frequency "f" of the votage supplied to liquid crystals is lowered to 1/(2T), thus unavoidably causing flicker in the display.

OBJECT AND SUMMARY OF THE INVENTION

Object of the Invention

In light of the above-mentioned disadvantage present in any conventional matrix-type liquid crystal display panel as described above, the present invention is intended to provide a new and useful method of driving a liquid crystal display panel capable of securely raising the frame frequency of the voltage supplied to liquid crystal without significant flicker appearing on the display.

Other objects and further scope of applicability of the present invention will become apparent from the detailed description given hereinfter. It should be understood, however, that the detailed description and specific examples, while indicating preferred embodiments of the invention, are given by way of illustration only, since various changes and modifications within the spirit and scope of the invention will become apparent to those skilled in the art from this detailed description.

SUMMARY OF THE INVENTION

To securely achieve the above objective, one of the preferred embodiments of the present invention provides the following operational steps: the division of a scan pulse supplied to a plurality of row electrodes of a matrix-type liquid crystal display panel into a plurality of scan periods; the supply of video signal data during the initial divided scan period via real time operation; the generation of a new signal source during the rest of the divided scan periods, and the supply of data from the new signal source to allow the writing of the designated data into liquid crystal layers. As a result, the preferred embodiment of the present invention raises the frame frequency of the voltage supplied to liquid crystal layers, thus realizing a liquid crystal display panel capable of stably displaying pictures without the slighest flicker.

BRIEF DESCRIPTION OF THE DRAWINGS

The present invention will be better understood from the detailed description given herein below and the accompanying drawings which are given by way of illustration only, and thus are not limitative of the present invention and wherein:

FIG. 1 (A) is a simplified block diagram of a prior art liquid crystal display panel provided with a number of switching transistors;

FIG. 1 (B) is of the waveforms of the main drive signals generated by the liquid crystal display panel shown in FIG. 1 (A);

FIG. 2 (B) is of the gate signal waveforms generated by the liquid crystal display panel driver circuit shown in FIG. 2 (A).

DETAILED DESCRIPTION OF THE PREFERRED EMBODIMENT

Figure 2A:
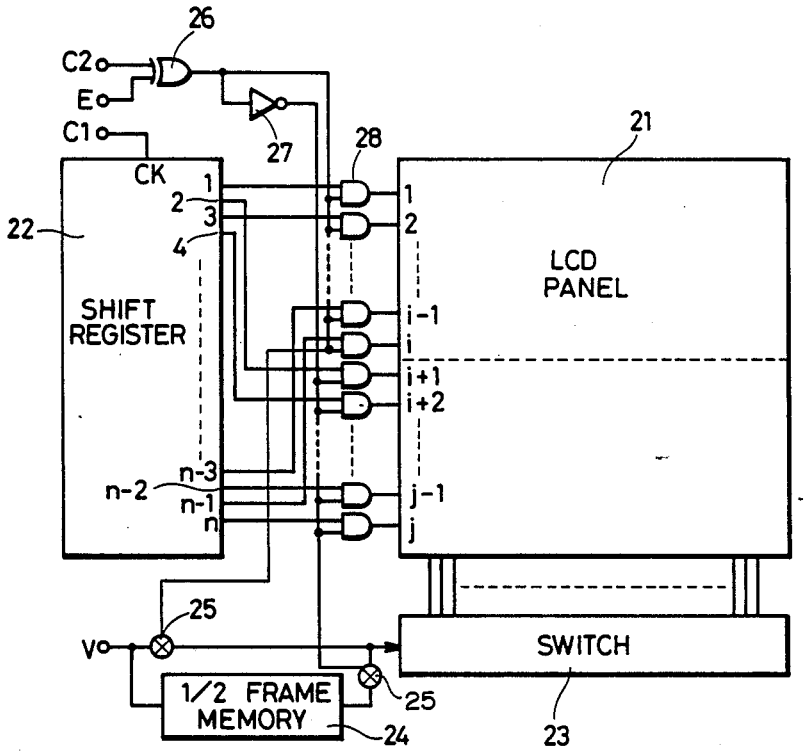
FIG. 2 (A) is a configuration of the liquid crystal display panel driver circuit reflecting one of the preferred embodiments of the present invention.
Figure 2B:
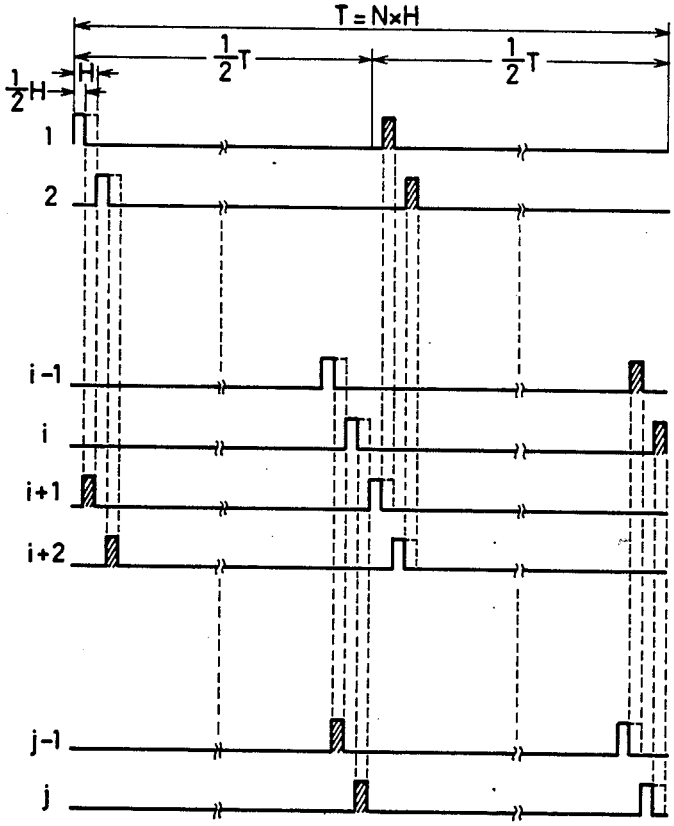

The principle of the method of driving the liquid crystal display panel reflecting the preferred embodiment of the present invention raises the frame frequency supplied to liquid crystals to an optimum level by dividing the width H of the scan pulse into a plurality of scan periods before supplying those split scan pulses to row electrodes connected to each gate of a plurality of switching transistors. Referring now to the application of the new driver method to the liquid crystal television set, the preferred embodiment is described below. FIGS. 2 (A) and (B) respectively show the configurations of the drive circuit and the gate signal waveforms embodied by the present invention, denoting the case where the width H of the scan pulse is halved. Reference number 22 indicates a shift-register operated by the clock signal C1 containing the frequency f1 =2/H. Reference number 26 indicates the exclusive OR circuit. Reference number 27 indicates the polarity inversion circuit. Reference number 28 indicates the AND circuit, in which C2 indicates the signal containing $(\frac{1}{2})f1$ of the frequency, whereas E indicates the signal containing $f2=2T$ of the frequency. FIG. 2 (B) shows the gate signal waveforms generated by those circuits shown in FIG. 2 (A).

The gate signal containing $(\frac{1}{2})H$ of the pulse width is supplied sequentially, the order being $1\rightarrow i+1\rightarrow 2\rightarrow i+2\rightarrow\cdots\rightarrow i-1\rightarrow j-1\rightarrow i\rightarrow j\rightarrow i+1\rightarrow 1\rightarrow i+2\rightarrow 2\rightarrow\cdots\rightarrow j-1\rightarrow i-1\rightarrow j\rightarrow i\rightarrow\cdots$, and so forth.

Reference number 24 indicates the $\frac{1}{2}$ frame memory provided for the data-side, which stores the video signals matching $\frac{1}{2}$ frame of the incoming video signal V. Reference number 25 indicates a switch that switches the real time data and the data of the $\frac{1}{2}$ frame memory. The data signals are delivered to the column electrodes synchronous with the gate signal via switch 23. Specifically, gate pulse H is first halved, and then the video signal data is supplied via real time operation during the first half $(\frac{1}{2})H$ of the scan period, while other data is supplied from the newly-set $\frac{1}{2}$ frame memory during the second half of the $(\frac{1}{2})H$ scan period. As a result, real time data is supplied while scanning is being performed on the 1 through i-th positions of the upper half portion of the liquid crystal display panel, whereas other data is supplied from the $\frac{1}{2}$ frame memory while scanning is being performed on the i+1-th through j-th positions of the lower half portion of the same display panel, thus completing the field 1 scanning operation over a duration of $(\frac{1}{2})T$. When scanning against the field 2, the lower-half of the liquid crystal display panel is provided with real-time data, whereas the upper-half portion receives other data supplied from the $\frac{1}{2}$ frame memory. When driving liquid crystals with AC current by inverting the polarity of the real-time data into the positive and the polarity of other data from the $\frac{1}{2}$ frame memory into the negative, the frame frequency becomes 1/T. As a result, when the width H of the scan pulse is halved, the frame frequency is doubled; likewise, when dividing the width of the scan pulse into n-th, the frame frequency can be raised n-times.

The invention being thus described, it will be obvious that the same may be varied in many ways without departure from the spirit and scope of the invention, which is limited only by the following claims.

What is claimed is:

1. A method of driving a liquid crystal display having j rows of display elements arranged in p columns, said j rows being sequentially clocked with row scan pulses while a video signal formed of a plurality of video frame signals is supplied to the display elements to display video information in sequentially displayed frames each defined by a said video frame signal, a full scan of said display corresponding in duration to the time of a video frame signal, comprising:

(a) dividing said display into N equisized display portions, each having j/N rows, where N is greater than one;

(b) providing a video frame memory for repetitively storing each said video frame signal, said video frame memory having memory portions including memory elements corresponding in number and arrangement to said display elements within said display portions;

(c) storing frame information contained in each video frame signal in said video frame memory;

(d) supplying one of said video frame signals to a display portion of said video display in real time; and (e) supplying the frame information of a preceding frame contained in said video frame memory to said display portions not receiving said video frame signal of said step d) during the time of said video frame signal supplied during step d.

2. The method of claim 1 wherein said video frame signal and said frame information stored in said video frame memory are applied to said video display in an interleaved fashion thereby reducing display flicker.

3. The method of claim 2 wherein N=2.

4. The method of claim 1 wherein N=2.

5. A method of driving a liquid crystal display having display elements arranged in rows and columns, said rows being clocked with row scan pulses while a video signal formed of a plurality of video frame signals is supplied to said columns to display video information in sequentially displayed frames each defined by a said video frame signal, comprising:

multiplying the scan frequency f of said row scan pulses by two;

applying said row scan pulses to two equisized display portions of the display having an equal number of rows, row scan pulses being alternately applied to each said display portion with every other row scan pulse being supplied to a next adjacent row of a said display portion;

storing frame information contained in each said video frame signal in a video frame memory storing one half of said frame information therein and corresponding in size to a said display portion;

supplying said video frame signal to said display in synchronism with alternate row scan pulses;

supplying elements of said frame information stored in said video frame memory in synchronism with row scan pulses other than said alternate row scan pulses, said elements of said frame information being recalled from positions in said video frame memory corresponding to the display portions being supplied with said element;

each of said two display portions thereby being supplied both said video frame signal and said stored frame information once during each display frame to thereby reduce display flicker.

6. A liquid crystal display system comprising:

a liqud crystal display having j rows of display elements arranged in p columns;

means for sequentially clocking said j rows of said display with row scan pulses;

means for supplying a video signal formed of a plurality of video frame signals to the display elements to display video information in sequentially displayed frames each defined by a said video frame signal in synchronism with said row scan pulses;

said liquid crystal display being divided into N equisized display portions each having j/N rows, where N is greater than one:

video frame memory means for repetitively storing frame information contained in each said video frame signal and having memory portions including memory elements corresponding in number and arrangement to said display elements within said display portions;

first means for selectively supplying one of said video frame signals to a display portion of said video display in real time; and second means for selectively supplying the frame information of a preceding frame contained in said video frame memory means to said display portions of said video display not receiving said video frame signal of said first means during each said video frame.

7. The system of claim 6 wherein said first and second means for selectively applying applies said video frame signal and said frame information stored in said video frame memory N-1 times to said display in an interleaved fashion, thereby reducing display flicker.

8. The system of claim 7 wherein N=2.

9. The system of claim 6 wherein N=2.

10. A liquid crystal display system comprising:

a liquid crystal display having display elements arranged in rows and columns;

means for clocking said rows of said display with row scan pulses;

means for supplying a video signal formed of a plurality of video frame signals to said columns to display video information in sequentially displayed frames each defined by a said video frame signal in synchronism with said row scan pulses;

means, responsive to said means for clocking, for multiplying the scan frequency f of said row scan pulses by two;

means for alternately applying said row scan pulses to two equisized display portions of the display having an equal number of rows, said means for alternately applying said scan pulses to each said display portion with every other row scan pulse being supplied to a next adjacent row of a said display portion;

display memory means for storing frame information contained in each said video frame signal, said display memory means storing one half of said frame information therein at any one time, said display memory means corresponding in size to a said display portion;

first means for supplying said video frame signal to said display in synchronism with alternate row scan pulses;

second means for supplying elements of said frame information stored in said video frame memory in synchronism with row scan pulses other than said alternate row scan pulses, said elements of said frame information being recalled from positions in said video frame memory means corresponding to the display portions being supplied with said element;

each of said two display portions thereby being supplied both said video frame signal and said stored frame information once during each display frame to thereby reduce display flicker.

* * * * *